US007722345B2

(12) United States Patent
Tanaka et al.

(10) Patent No.: US 7,722,345 B2
(45) Date of Patent: May 25, 2010

(54) SCREW COMPRESSOR

(75) Inventors: Eitarou Tanaka, Nagoya (JP); Hiroshi Okada, Kariya (JP)

(73) Assignee: DENSO CORPORATION, Kariya (JP)

( * ) Notice: Subject to any disclaimer, the term of this patent is extended or adjusted under 35 U.S.C. 154(b) by 374 days.

(21) Appl. No.: 11/797,384

(22) Filed: May 3, 2007

(65) Prior Publication Data

US 2007/0280846 A1 Dec. 6, 2007

(30) Foreign Application Priority Data

Jun. 5, 2006 (JP) ..... 2006-155991

(51) Int. Cl.
*F01C 1/16* (2006.01)

(52) U.S. Cl. ..... 418/201.1; 418/201.2; 418/201.3

(58) Field of Classification Search ..... 418/191–206.9
See application file for complete search history.

(56) References Cited

U.S. PATENT DOCUMENTS

| | | | | |
|---|---|---|---|---|
| 2,705,922 | A * | 4/1955 | Rathman | 418/201.1 |
| 3,113,524 | A * | 12/1963 | Fulton | 418/79 |
| 3,622,256 | A * | 11/1971 | Borisoglebsky et al. | 418/201.3 |
| 4,556,373 | A * | 12/1985 | Soeters, Jr. | 418/75 |
| 4,569,646 | A * | 2/1986 | Soeters, Jr. | 418/95 |
| 4,770,615 | A * | 9/1988 | Fujiwara et al. | 418/15 |
| 5,078,583 | A * | 1/1992 | Hampton et al. | 418/201.1 |
| 5,083,907 | A * | 1/1992 | Brownell | 417/440 |
| 5,118,268 | A * | 6/1992 | Crisenbery et al. | 418/189 |
| 5,131,829 | A * | 7/1992 | Hampton | 418/189 |
| 5,295,798 | A * | 3/1994 | Maruyama et al. | 418/201.1 |
| 5,374,173 | A * | 12/1994 | Maruyama et al. | 418/201.1 |
| 6,663,366 | B2 * | 12/2003 | Okada et al. | 418/83 |

FOREIGN PATENT DOCUMENTS

| | | |
|---|---|---|
| JP | A-55-007948 | 1/1980 |
| JP | U-60-118390 | 8/1985 |
| JP | A-7-63180 | 3/1995 |
| JP | A-8-338386 | 12/1996 |
| JP | A-9-219891 | 8/1997 |
| JP | A-2005-220785 | 8/2005 |

* cited by examiner

*Primary Examiner*—Thomas Denion
*Assistant Examiner*—Douglas J. Duff
(74) *Attorney, Agent, or Firm*—Posz Law Group, PLC

(57) ABSTRACT

In a screw compressor, a pair of rotors are located in a housing to be rotatable around their rotary axes to form in the housing a compression chamber in which gas sucked from a suction port of the housing is compressed thereby discharging the compressed gas from a discharge port of the housing. The suction port is provided in the housing at a position radial outside of the rotors, and the housing is provided with a communication passage through which the suction port communicates with the compression chamber before being communicated with the suction port. Furthermore, the communication passage is provided such that the gas sucked from the suction port flows into the communication passage in a direction approximately parallel with an axial direction of the rotors.

12 Claims, 3 Drawing Sheets

SCREW COMPRESSOR

CROSS REFERENCE TO RELATED APPLICATION

This application is based on Japanese Patent Application No. 2006-155991 filed on Jun. 5, 2006, the contents of which are incorporated herein by reference in its entirety.

BACKGROUND OF THE INVENTION

1. Field of the Invention

The present invention relates to a screw compressor having a pair of rotors rotatable around its rotary axes.

2. Description of the Related Art

FIG. 5 shows a conventional screw compressor including a pair of male and female rotors J1, J2 having spiral teeth that are provided to be engaged with each other (e.g., JP-A-2005-220785). In this screw compressor, by rotating the male rotor J1 and the female rotor J2 in a housing J6, gas is drawn from a suction port J6*a* into a compression chamber formed between tooth tips and tooth roots (grooves) of the rotors J1, J2. Then, the gas compressed in the compression chamber is discharged from a discharge port J6*b* of the housing.

In this screw compressor, after the volume of the compression chamber is gradually expanded from the zero, the compression chamber is made to communicate with the suction port J6*a*. Therefore, a negative pressure is generated in the compression chamber before being communicated with the suction port J6*a* (i.e., the area X shown in FIG. 5), thereby causing a drive loss during the rotation of the rotors J1, J2. In order to prevent the generation of the pressure loss in the compression chamber, a groove for communicating the compression chamber and the suction port J6*a* may be provided on an end surface of the rotors J1, J2.

However, when the suction port J6*a* is provided in the housing J6 to be opened in a radial direction, a gas flow Y, pushed toward the suction port J6*a* by the rotation of the rotors J1, J2, is generated toward radial outside of the rotors J1, J2, thereby this gas flow Y disturbs a gas flow from the suction port J6*a* into a groove J6*c* shown in FIG. 6. Accordingly, it is impossible to sufficiently reduce the negative pressure generated in the compressor chamber before being communicated with the suction port J6*a*.

SUMMARY OF THE INVENTION

In view of the foregoing problems, it is an object of the present invention to provide a screw compressor having a suction port provided at a radial outside of a pair of rotors, which effectively reduces a negative pressure generated in a compression chamber.

According to an example of the present invention, a screw compressor includes a housing for defining therein an internal space and having a suction port and a discharge port; and a pair of rotors having spiral teeth which are provided to be engaged with each other. The rotors are located in the housing to be rotatable around their rotary axes to form in the internal space a compression chamber in which gas sucked from the suction port is compressed thereby discharging the compressed gas from the discharge port. The suction port is provided in the housing at a position radial outside of the rotors, and the housing is provided with a communication passage through which the suction port communicates with the compression chamber before being communicated with the suction port. Furthermore, the communication passage is provided such that the gas sucked from the suction port flows into the communication passage in a direction approximately parallel with an axial direction of the rotors.

Because the gas sucked from the suction port flows into the communication passage in the direction approximately parallel with the axial direction, a gas flow from the suction port is not affected by a pushed gas due to the rotation of the rotors in the housing. Accordingly, a negative pressure generated in the compression chamber before being communicated with the suction port can be effectively reduced.

For example, a bearing portion may be disposed in the housing to rotatably support the rotors. In this case, the communication passage may be provided in the housing at a position different from the bearing portion.

Alternatively, a first rotation transmission mechanism may be located at one end side of the rotors in the axial direction, and a second rotation transmission mechanism may be located at the other end side of the rotors in the axial direction. In this case, the first and second rotation transmission mechanisms are located to synchronously rotate the rotors at a constant ratio, the housing has therein a driving transmission space in which the first rotation transmission mechanism is received, and the driving transmission space is a part of the communication passage. Furthermore, the housing may have a wall portion which partitions the driving transmission space and the compression chamber from each other. In this case, the communication passage includes a first passage portion through which the gas is introduced from the suction port to the driving transmission space, and a second passage portion through which the gas is introduced from the driving transmission space to the compression chamber. In addition, the first passage portion may be provided in parallel with the axial direction.

Alternatively, first and second rotation transmission mechanisms may be located at one end side of the rotors in the axial direction, to synchronously rotate the rotors at a constant ratio. In this case, the housing has therein a space in which the first and second rotation transmission mechanisms are received, the housing includes a cover member located at a side opposite to the first and second rotation transmission mechanisms with respect to the rotors in the axial direction, and the communication passage is provided in the cover member such that the suction port communicates with the compression chamber through the communication passage.

According to another example of the present invention, a suction port is provided in a housing at a position radial outside of a pair of rotors, and a communication passage portion through which the suction port communicates with a compression chamber before being communicated with the suction port may be provided. In this case, the communication passage portion has a gas introducing portion directly communicating with the suction port, and the gas introducing portion extends approximately in parallel with an axial direction of the rotors such that gas in the suction port is introduced into the communication passage portion from the gas introducing portion. Accordingly, a gas flow from the suction port is not affected by a pushed gas flow due to the rotation of the rotors, and a negative pressure generated in the compression chamber before being communicated with the suction port can be effectively reduced.

BRIEF DESCRIPTION OF THE DRAWINGS

Additional objects and advantages of the present invention will be more readily apparent from the following detailed description of preferred embodiments when taken together with the accompanying drawings. In which.

DETAILED DESCRIPTION OF THE PREFERRED EMBODIMENTS

First Embodiment

A first embodiment of the present invention will be now described with reference to FIGS. 1 to 3.

Figure 3:
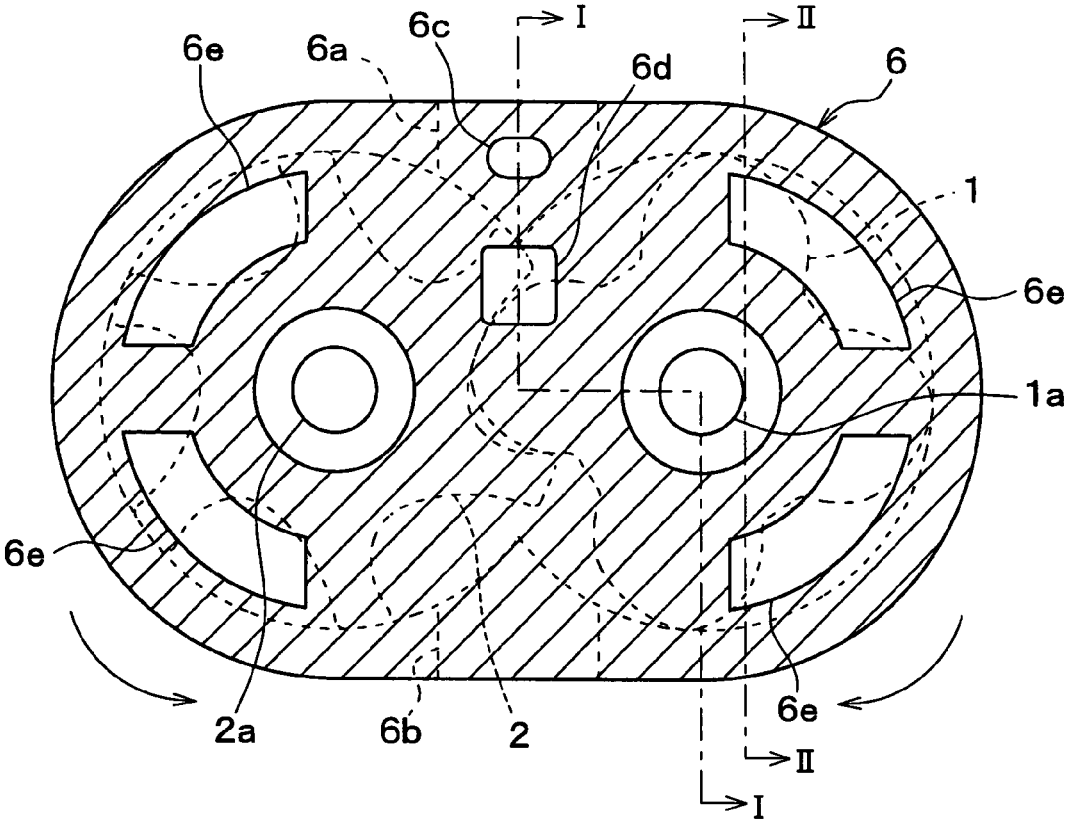
FIG. 3 is a cross-sectional view showing the screw compressor taken along the line III-III in FIG. 1.

A screw compressor of this embodiment includes a pair of screw-shaped male rotor 1 and female rotor 2 shown in FIG. 3, a casing 3 for housing the pair of rotors 1, 2, an input shaft 4 for receiving a rotational force of a driving source, rotation transmission mechanisms 8 to 10 for rotating and driving the rotors 1, 2 by the rotational force of the driving source, and the like. In FIG. 1, the pair of rotors 1, 2 are arranged side by side on the back side of the paper and on the front side thereof.

The male rotor 1 and the female rotor 2 are formed respectively in the shape of a screw so as to engage with each other, such that spiral projections are formed on outer peripheral surfaces of the rotors 1, 2. A shown in FIG. 3, the male rotor 1 and the female rotor 2 are constructed in such a way that a tooth tip of the male rotor 1 is engaged with a tooth root (groove) of the female rotor 2 and that a tooth root (groove) of the male rotor 1 is engaged with a tooth tip of the female rotor 2. When the respective rotors 1, 2 are rotated, a groove space is formed between the tooth tip of the male rotor 1 and the tooth root (groove) of the female rotor 2 and a groove space is formed between the tooth root (groove) of the male rotor 1 and the tooth tip of the female rotor 2. A compression chamber 16*a*, in which gas is compressed, is constructed by these groove spaces.

Figure 1:
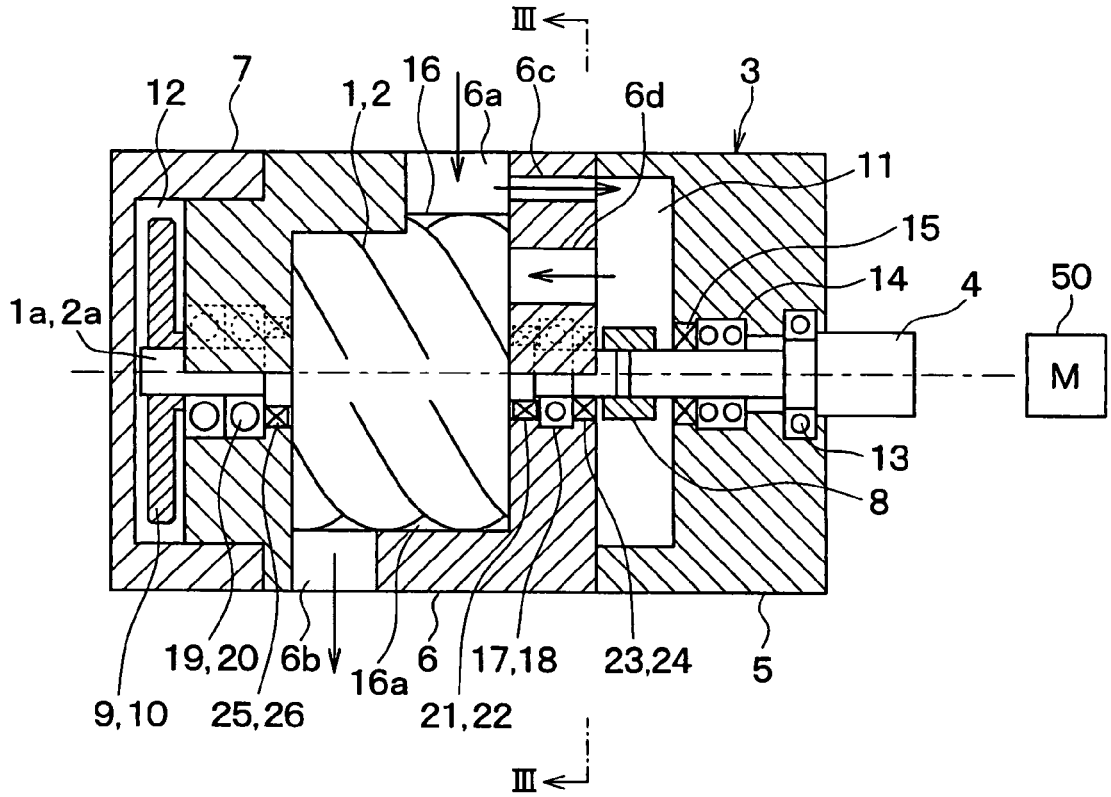
FIG. 1 is a cross-sectional view showing a screw compressor taken along the line I-I in FIG. 3.

As shown in FIG. 1, the male rotor 1 and the female rotor 2 are rotated and driven by the rotation transmission mechanisms 8 to 10 provided with the rotational force from the driving source of an electric motor 50 or the like. In this embodiment, the male rotor 1 is positioned on a driving side, and the female rotor 2 is positioned on a driven side. The male rotor 1 and the female rotor 2 are rotated around rotary shafts 1*a*, 2*a*, respectively.

The casing 3 includes a driving transmission part 5, a rotor housing 6, and a lubrication box 7 in the order from a position closer to the motor 50. The driving transmission part 5, the rotor housing 6, and the lubrication box 7 are strongly assembled with each other with fastening means such as bolts or the like (not shown). The pair of rotors 1, 2 and the rotation transmission mechanisms 8 to 10 are housed in the casing 3 in such a way as to be separated from each other. The pair of rotors 1, 2 is housed in the rotor housing 6. Specifically, the rotation transmission mechanism 8 is housed in the driving transmission part 5. The rotation transmission mechanisms 9, 10 are housed in the lubrication box 7 to be separated from the rotation transmission mechanism 8.

The lubrication box 7 is provided with a lubrication oil space 12 in which the rotation transmission mechanisms 9, 10 and lubrication oil to be supplied to the rotation transmission mechanisms 9, 10 are housed. Oil having the same viscosity as an engine oil, for example, can be used as the lubrication oil. The gears constructing the rotation transmission mechanisms 9, 10 are sprayed with the lubrication oil in the lubrication oil space 12, thereby being lubricated with the lubrication oil.

The driving transmission part 5 is provided with the input shaft 4 for receiving the rotational force from the motor 50. The driving transmission part 5 has a first bearing 13 disposed on the motor 50 side and has a second bearing 14 disposed on the driving transmission space 11 side. The input shaft 4 is supported by the driving transmission part 5 via these bearings 13, 14. A first oil seal 15 for preventing grease sealed in the first and second bearings 13, 14 from flowing outside of a compression chamber 16*a* is fitted in an insertion hole which is formed in the driving transmission part 5 and into which the input shaft 4 is inserted.

A rotor chamber 16 in which the pair of rotors 1, 2 are housed is formed in the rotor housing 6. The rotor housing 6 has a suction port 6*a* for sucking air into the rotor chamber 16 and a discharge port 6*b* for discharging air outside of the rotor chamber 16. The suction port 6*a* and the discharge port 6*b* are formed in such a way that the gas flows in the radial direction of the rotors 1, 2.

The suction port 6*a* is formed in the rotor housing 6 at an end portion in the axial direction, on a side of the driving transmission part 5. The discharge port 6*b* is formed in the rotor housing 6 at an end portion in the axial direction, on a side of the lubrication box 7. Further, the rotor housing 6 has communication passages 6*c*, 6*d*, and 6*e* formed therein. These communication passages 6*c*, 6*d*, and 6*e* will be described later.

A seal structure having a small clearance formed therein is formed between the outer peripheral tips of the rotors 1, 2 and the inner wall of the rotor chamber 16. The compression chamber 16*a* for compressing air sucked from the suction port 6*a* is formed between the rotors 1, 2 and the inner wall of the rotor chamber 16.

The rotors 1, 2 are rotated and driven by the rotation transmission mechanisms 8 to 10. The rotation transmission mechanisms 8 to 10 are constructed in such a way as to transmit the rotation force of the input shaft 4 to the male rotor rotary shaft 1*a* and the female rotor rotary shaft 2*a* and to rotate the pair of rotors 1, 2 synchronously at a constant ratio. The rotation transmission mechanisms 8 to 10 are constructed of a coupling 8, first and second gears 9, 10, and the like. The coupling 8 transmits the rotation of the input shaft 4 driven by the motor 50 to the male rotor rotary shaft 1*a* in a coaxial manner, the first and second gears 9, 10 transmits the rotation transmitted from the coupling 8 to the male rotor rotary shaft 1*a* and to the female rotor rotary shaft 2*a*. The first and second gears 9, 10 are timing gears for rotating the pair of rotors 1, 2 synchronously at the constant ratio. The coupling 8 is disposed in the driving transmission space 11, and the first and second gears 9, 10 are disposed in the lubrication oil space 12.

The male rotor rotary shaft 1*a* and the female rotor rotary shaft 2*a* have their one ends rotatably supported by the driving transmission part 5 side of the rotor housing 6 via third and fourth bearings 17, 18. The male rotor rotary shaft 1*a* and the female rotor rotary shaft 2*a* have their other ends rotatably supported by the lubrication box 7 side of the rotor housing 6 via fifth and sixth bearings 19, 20. Moreover, second and third oil seals 21, 22 for preventing grease sealed in the third and fourth bearings 17, 18 from leaking into the rotor chamber 16 are fitted into insertion holes which are formed on the driving transmission part 5 side of the rotor housing 6 and in which the rotor rotary shafts 1*a*, 2*a* are inserted. Furthermore, fourth and fifth oil seals 23, 24 for preventing the grease sealed in the third and fourth bearings 17, 18 from leaking into the driving transmission space 11 are fitted into the insertion holes of the rotor housing 6. Furthermore, sixth and seventh oil seals 25, 26 for preventing the grease sealed in the fifth and sixth bearings 19, 20 and the lubrication oil in the lubrication oil space 12 from leaking into the rotor chamber 16 are fitted also into insertion holes which are formed in the rotor housing 6 on a side of the lubrication box 7 and in which the rotor rotary shafts 1*a*, 2*a* are inserted.

Next, the communication passages 6*c*, 6*d*, and 6*e* formed in the rotor housing 6 of this embodiment will be described.

Figure 2:
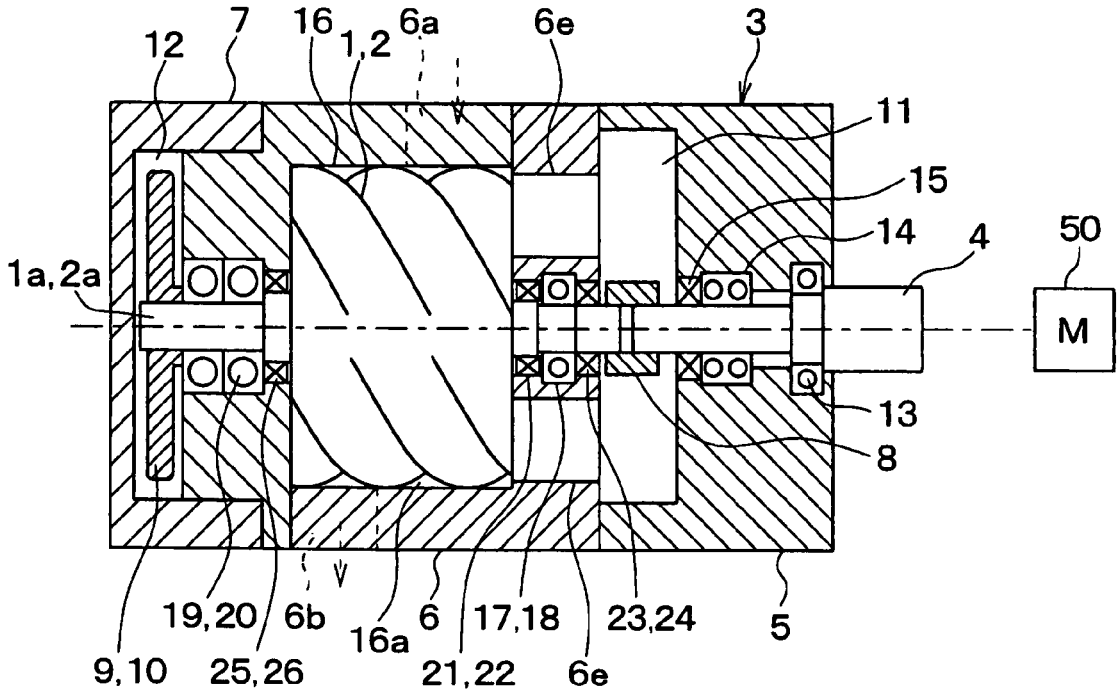
FIG. 2 is a cross-sectional view showing the screw compressor taken along the line II-II in FIG. 3.

As shown in FIG. 1 to FIG. 3, the rotor housing 6 is provided with a first communication passage 6*c* through which the suction port 6*a* communicates with the driving transmission space 11, and a second communication passage 6*d* through which the driving transmission space 11 communicates with the rotor chamber 16. The first communication passage 6*c* communicates with the suction port 6*a*, and the second communication passage 6*d* communicates with the compression chamber 16*a*. The first and second communication passages 6*c* and 6*d* are formed at separate positions of the rotor housing 6 in such a way as to be separated from each other. As shown in FIG. 1, the second communication passage 6*d* is formed in parallel to the axial direction of the rotors 1, 2. For this reason, the gas sucked into the compression chamber 16*a* from the second communication passage 6*d* flows in the axial direction of the rotors 1, 2.

As shown in FIG. 3, the first communication passage 6*c* is formed at a position corresponding to the suction port 6*a*, and the second communication passage 6*d* is formed at a position corresponding to the end surfaces of the rotors 1, 2. These communication passages 6*c*, 6*d* are formed in dead spaces in which the bearings 17, 18 are not disposed in the rotor housing 6. That is, the communication passages 6*c*, 6*d* are provided at positions different from the bearings 17, 18.

The second communication passage 6*d* is formed at a position corresponding to the compression chamber 16*a* near the suction port 6*a* in the rotor chamber 16. The tooth tip and the tooth root (groove) of the rotors 1, 2, which are engaged with each with no clearance between them, are moved to the suction port 6*a* with the rotation of the rotors 1, 2 to produce a volume between the rotors 1, 2, thereby starting to form the compression chamber 16*a*. The compression chamber 16*a* near the suction port 6*a* in the rotor chamber 16 is a chamber 16*a* as a volume producing space which starts to be formed between the rotors 1, 2 and does not yet reach and communicate with the suction port 6*a*.

The volume producing space is formed in an area in which the tooth tip and the tooth root (groove) of the two rotors 1, 2 engaged with each other start to be separated from each other. In other words, in an area in which two imaginary circles having diameters of lengths from the central axes 1*a*, 2*a* of the two rotors 1, 2 to their tooth tips overlap each other, the vicinity near a straight line connecting the central axes 1*a*, 2*a* of the rotors 1, 2 becomes the volume producing space. The volume producing space communicates with the suction port 6*a* via the first communication passage 6*c*, the driving transmission space 11, and the second communication passage 6*d*. In this manner, in this embodiment, the first communication passage 6*c*, the driving transmission space 11, and the second communication passage 6*d* construct a pressure introducing communication passage for making the suction port 6*a* communicate with the compression chamber 16*a* which does not yet communicate with the suction port 6*a*.

Moreover, as shown in FIG. 2 and FIG. 3, the rotor housing 6 has the third communication passage 6*e* formed therein, and the third communication passage 6*e* makes the driving transmission space 11 communicate with the rotor chamber 16. As shown in FIG. 3, the third communication passage 6*e* is formed at a position corresponding to the end surfaces of the rotors 1, 2. The third communication passage 6*e* is formed in a dead space in which the bearings 17, 18 are not disposed in the rotor housing 6. Specifically, the third communication passage 6*e* is formed in an area which is located between the suction port 6*a* and the discharge port 6*b* in the rotor chamber 16 and which does not communicate with the suction port 6*a* and the discharge port 6*b*.

Next, the operation of the screw compressor of this embodiment will be described. When the pair of rotors 1, 2 are synchronously rotated at a constant ratio by the rotation transmission mechanisms 8 to 10, air is sucked into the compression chamber 16*a* from the suction port 6*a* formed on the rotor housing 6 on the side of the driving transmission space 11.

With the rotation of the pair of rotors 1, 2, the compression chamber 16*a* sucking air from the suction port 6*a* is moved from the driving transmission space 11 to the lubrication oil space 12 and is reduced in volume. Thus, the air in the compression chamber 16*a* is gradually compressed, pressurized, and moved toward the lubrication oil space 12.

When the rotational angles of the pair of rotors 1, 2 reach specified angles, the compression chamber 16*a* reaches the discharge port 6*b* formed in the rotor housing 6 on the side of the lubrication oil space 12. Then, the compression chamber 16*a* having been tightly closed until that time is brought to a state opened at the discharge port 6*b*, so the compressed air in the compression chamber 16*a* is discharged from the discharge port 6*b*.

With the foregoing construction, before the compression chamber 16*a* formed between the rotors 1, 2 reaches the suction port 6*a*, the compression chamber 16*a* communicates with the suction port 6*a* via the second communication passage 6*d*, the driving transmission space 11, and the first communication passage 6*c*. For this reason, pressure in the compression chamber 16*a* which does not yet communicate with the suction port 6*a* becomes equal to pressure at the suction port 6*a* (atmospheric pressure). With this, it is possible to prevent a negative pressure from being produced in the compression chamber 16*a* before being communicated with the suction port 6*a* and to prevent power loss from being generated in the rotors 1, 2.

Moreover, because the compression chamber 16*a*, which does not yet communicate with the suction port 6*a*, communicates with a comparatively large space of the driving transmission space 11 via the second transmission passage 6*d*, it is possible to secure a sufficient quantity of gas to flow into the compression chamber 16*a*. Further, according to the first embodiment, the driving transmission space 11 can be used as a part of a communication passage for making the compression chamber 16*a*, which does not yet communicate with the suction port 6*a*, communicate with the suction port 6*a*.

Moreover, in the construction of this embodiment, the second transmission passage 6*d* is formed in parallel to the axial direction of the rotors 1, 2. Therefore, gas sucked into the volume producing space in the compression chamber 16*a* from the second communication passage 6*d* is sucked from the axial direction of the rotors 1, 2. For this reason, it is possible to prevent the flow of gas flowing into the volume producing space in the compression chamber 16*a* from the suction port 6*a*, from being blocked by flow produced by gas pushed out to the suction port 6*a* by the rotation of the rotors 1, 2. As a result, it is possible to effectively prevent a negative pressure from being produced in the compression chamber 16*a* which does not yet communicate with the suction port 6*a*.

Moreover, when the rotors 1, 2 are rotated at high speeds, air is sucked from the suction port 6*a*, whereby the compression chamber 16*a* is brought to the atmospheric pressure on one end side thereof and is brought to a low pressure on the other end side away from the suction port 6*a*. When a pressure difference occurs in the compression chamber 16*a* in this manner, compression efficiency becomes low. In contrast to this, in this embodiment, the end surfaces of the rotors 1, 2 communicate with the driving transmission space 11 through the third communication passage 6*e*. Thus, in the compression chamber 16*a*, air can be sucked on the one end side thereof from the suction port 6*a* and can be sucked on the other end side thereof from the driving transmission space 11. With this, it is possible to prevent a pressure difference from being produced in the compression chamber 16 and hence to prevent compression efficiency from being decreased.

Second Embodiment

Next, a second embodiment of the present invention will be described with reference to FIG. 4. The same functional parts as in the first embodiment are denoted by the same reference symbols and their descriptions will be omitted and only different parts will be described.

Figure 4:
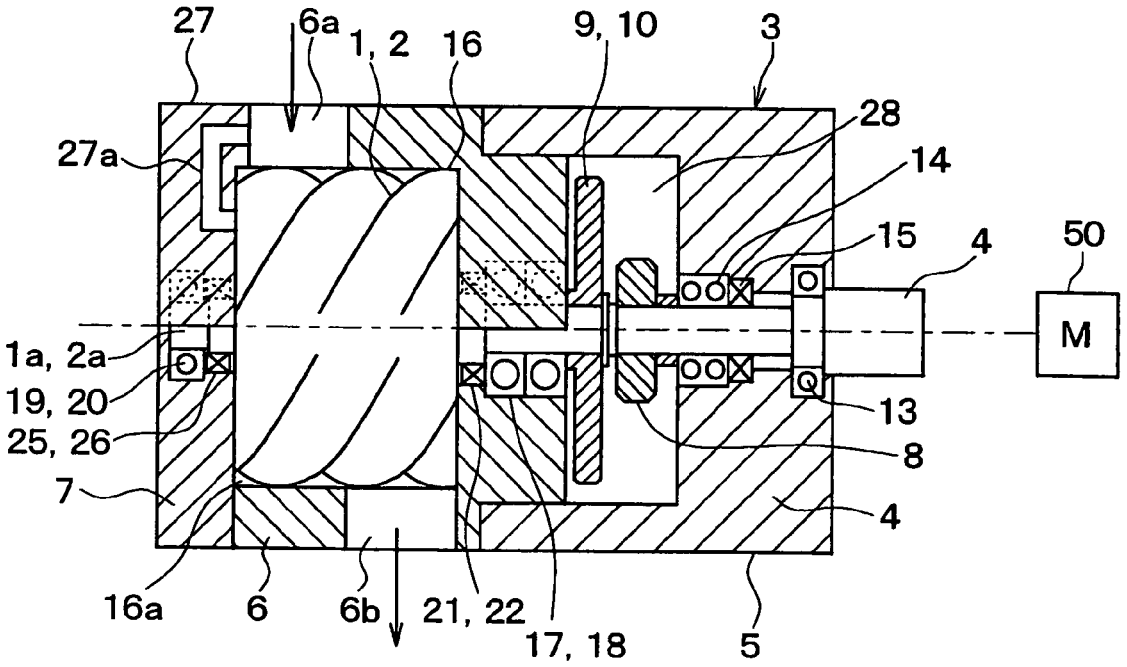
FIG. 4 is a cross-sectional view showing a screw compressor according to a second embodiment of the present invention.
Figure 5:
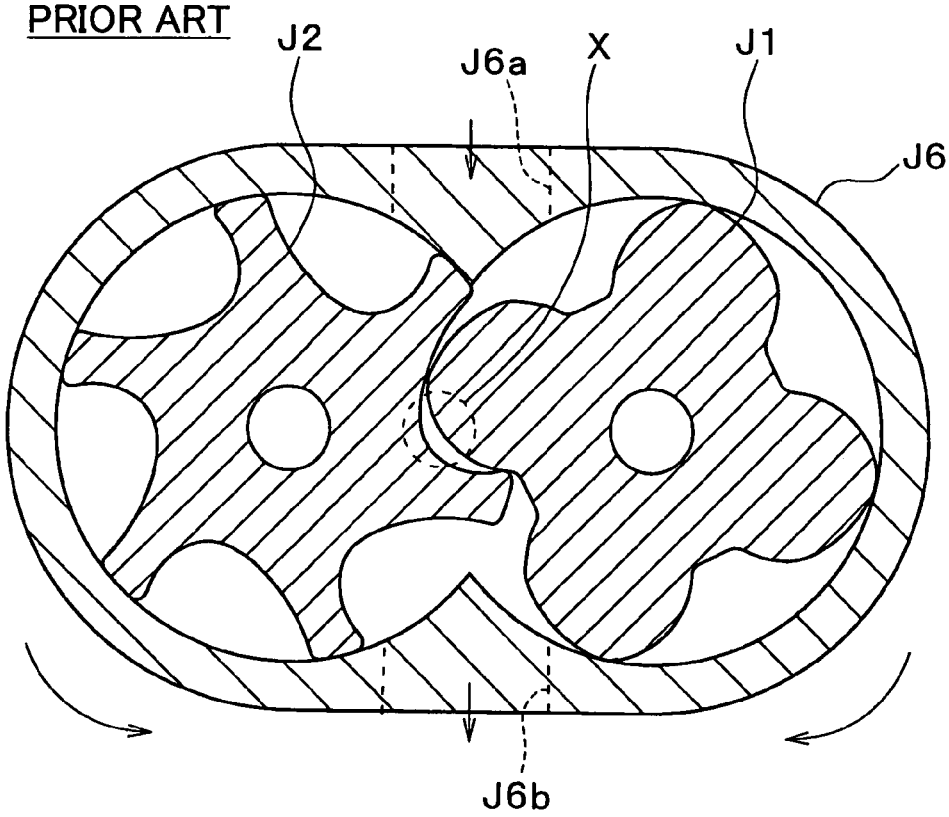
FIG. 5 PRIOR ART
FIG. 5 is a cross-sectional view showing a conventional screw compressor.
Figure 6:
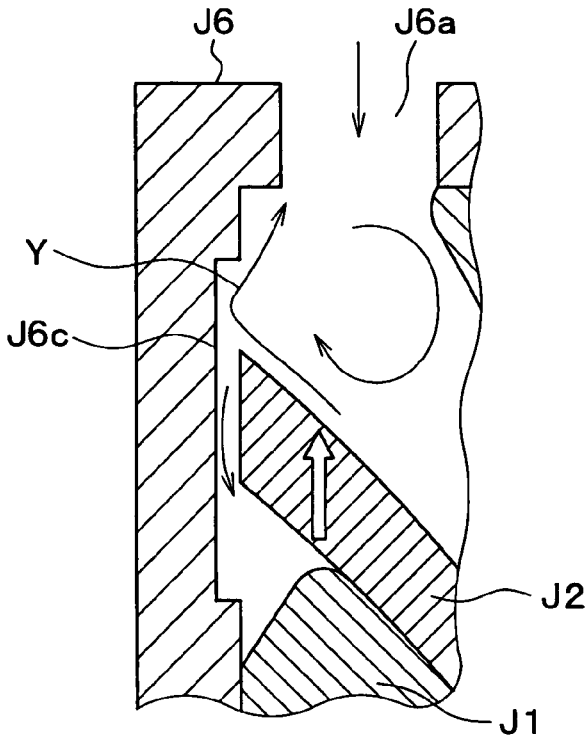
FIG. 6 PRIOR ART
FIG. 6 is a cross-sectional view showing a part of the conventional screw compressor, adjacent to a suction port.

FIG. 4 is a sectional view of a screw compressor of the second embodiment. As shown in FIG. 4, in this embodiment, a coupling 8, and first and second gears 9, 10 constructing the rotation transmission mechanisms are arranged in the same lubrication oil space 28. A housing cover 27 is disposed on the opposite side of the driving transmission part 5 in the rotor housing 6. The housing cover 27 constructs a part of the housing 6 and is provided with the fifth and sixth bearings 19, 20 and the sixth and seventh oil seals 25, 26.

Moreover, the suction port 6*a* is formed in the rotor housing 6 on a side of the cover 27, and the discharge port 6*b* is formed in the rotor housing 6 on a side of the lubrication oil space 28. A communication passage 27*a* for making the suction portion 6*a* communicate with the compression chamber 16*a*, before being communicated with the suction port 6*a*, is formed near the suction port 6*a* in the housing cover 27. A portion communicating with the suction port 6*a* in the communication passage 27*a* and a portion communicating with the compression chamber 16*a* in the communication passage 27*a* are formed so as to be parallel to the axial direction of the rotors 1, 2. Moreover, the communication passage 27*a* is formed in a dead space in which the bearings 19, 20 are not disposed in the rotor housing 6. The communication passage 27*a* is a pressure introducing communication passage through which the pressure can be introduced from the suction port 6*a* to the compression chamber 16*a*.

In the screw compressor of the second embodiment, the portion communicating with the suction port 6*a* in the communication passage 27*a* is provided in parallel to the axial direction of the rotors 1, 2. Thus, like the first embodiment, it is possible to prevent the flow of gas flowing into the volume producing space in the compression chamber 16*a* from the suction port 6*a*, from being blocked due to flow produced by gas that is pushed out to the suction port 6*a* by the rotation of the rotors 1, 2. With this, it is possible to effectively prevent a negative pressure from being produced in the compression chamber 16*a* before being communicated with the suction port 6*a*.

Other Embodiments

Although the present invention has been fully described in connection with the preferred embodiments thereof with reference to the accompanying drawings, it is to be noted that various changes and modifications will become apparent to those skilled in the art.

For example, in the foregoing embodiments, the pressure introducing communication passage (6*c*, 6*d*, 11, 27*a*) is made to communicate with the suction port 6*a* formed in the rotor housing 6. However, when, for example, a duct is connected to the suction port 6*a* of the rotor housing 6 and the suction port 6*a* is extended, a pressure introducing communication passage may be provided so as to be made to communicate with the duct.

Moreover, in the foregoing embodiments, the portion communicating with the suction port 6*a* in the pressure introducing communication passage (6*c*, 6*d*, 11, 27*a*) and the portion communicating with the compression chamber 16*a* in the pressure introducing communication passage (6*c*, 6*d*, 11, 27*a*) are formed in such a way as to be separated from each other. However, it suffices to make gas sucked from the suction port 6*a* into the pressure introducing communication passage (6*c*, 6*d*, 11, 27*a*) to flow in the axial direction of the rotors 1, 2. The portion communicating with the suction port 6*a* in the pressure introducing communication passage (6*c*, 6*d*, 11, 27*a*) does not need to be separated from the portion communicating with the compression chamber 16*a*.

Such changes and modifications are to be understood as being within the scope of the present invention as defined by the appended claims.

What is claimed is:

1. A screw compressor comprising:

a housing for defining therein an internal space, the housing having a suction port and a discharge port; and a pair of rotors having spiral teeth which are provided to be engaged with each other; and a rotation transmission mechanism for rotating the rotors, wherein the rotors are located in the housing to be rotatable around their rotary axes to form in the internal space a compression chamber in which gas sucked from the suction port is compressed thereby discharging the compressed gas from the discharge port, wherein the suction port is provided in the housing at a position that is radially outside of the rotors, wherein the housing is provided with a communication passage through which the suction port communicates with the compression chamber before a time when the compression chamber would otherwise be communicated with the suction port, wherein the communication passage is provided such that the gas sucked from the suction port flows into the communication passage in a direction approximately parallel with an axial direction of the rotors, wherein the housing has therein a space in which the rotation transmission mechanism is received, and wherein the space is a part of the communication passage.

2. The screw compressor according to claim 1, wherein the communication passage has a passage portion directly communicating with the suction port, and wherein the passage portion extends in a direction that is parallel to the axial direction of the rotors.

3. The screw compressor according to claim 1, further comprising a bearing portion disposed in the housing to rotatably support the rotors, wherein the communication passage is provided in the housing at a position different from that of the bearing portion.

4. A screw compressor comprising:

a housing for defining therein an internal space, the housing having a suction port and a discharge port; and a pair of rotors having spiral teeth which are provided to be engaged with each other;

a first rotation transmission mechanism located at one end of the rotors in an axial direction of the rotors; and a second rotation transmission mechanism located at the other end of the rotors in the axial direction, wherein the rotors are located in the housing to be rotatable around their rotary axes to form in the internal space a compression chamber in which gas sucked from the suction port is compressed thereby discharging the compressed gas from the discharge port, wherein the suction port is provided in the housing at a position that is radially outside of the rotors, wherein the housing is provided with a communication passage through which the suction port communicates with the compression chamber before a time when the compression chamber would otherwise be communicated with the suction port, wherein the communication passage is provided such that the gas sucked from the suction port flows into the communication passage in a direction approximately parallel with the axial direction of the rotors, wherein the first and second rotation transmission mechanisms are located to synchronously rotate the rotors at a constant ratio, wherein the housing has therein a driving transmission space in which the first rotation transmission mechanism is received, and wherein the driving transmission space is a part of the communication passage.

5. The screw compressor according to claim 4, wherein the housing has a wall portion which partitions the driving transmission space and the compression chamber from each other;

wherein the communication passage includes a first passage portion, through which the gas is introduced from the suction port to the driving transmission space, and a second passage portion, through which the gas is introduced from the driving transmission space to the compression chamber; and wherein the first passage portion is parallel to the axial direction of the rotors.

6. The screw compressor according to claim 5, wherein the second passage portion is provided radially inside of the first passage portion and extends in a direction parallel to the axial direction of the rotors.

7. A screw compressor comprising:

a housing for defining therein an internal space, the housing having a suction port and a discharge port;

a pair of rotors having spiral teeth which are provided to be engaged with each other; and first and second rotation transmission mechanisms located at one end of the rotors in the axial direction, to synchronously rotate the rotors at a constant ratio, wherein the rotors are located in the housing to be rotatable around their rotary axes to form a compression chamber in the internal space in which gas sucked from the suction port is compressed thereby discharging the compressed gas from the discharge port, wherein the suction port is provided in the housing at a position that is radially outside of the rotors, wherein the housing is provided with a communication passage through which the suction port communicates with the compression chamber before a time when the compression chamber would otherwise be communicated with the suction port, and wherein the communication passage is provided such that the gas sucked from the suction port flows into the communication passage in a direction approximately parallel to an axial direction of the rotors, wherein the housing has therein a space in which the first and second rotation transmission mechanisms are received, wherein the housing includes a cover member located at a side opposite to the first and second rotation transmission mechanisms with respect to the rotors in the axial direction, and wherein the communication passage is provided in the cover member such that the suction port communicates with the compression chamber through the communication passage.

8. The screw compressor according to claim 7, wherein the suction port is provided in the housing adjacent to the suction port in the axial direction.

9. The screw compressor according to claim 4, wherein the communication passage has a passage portion directly communicating with the suction port, and wherein the passage portion extends in a direction that is parallel to the axial direction of the rotors.

10. The screw compressor according to claim 4, further comprising a bearing portion disposed in the housing to rotatably support the rotors, wherein the communication passage is provided in the housing at a position different from that of the bearing portion.

11. The screw compressor according to claim 7, wherein the communication passage has a passage portion directly communicating with the suction port, and wherein the passage portion extends in a direction that is parallel to the axial direction of the rotors.

12. The screw compressor according to claim 7, further comprising a bearing portion disposed in the housing to rotatably support the rotors, wherein the communication passage is provided in the housing at a position different from that of the bearing portion.

* * * * *